US007880579B2

(12) United States Patent
Feist et al.

(10) Patent No.: US 7,880,579 B2
(45) Date of Patent: Feb. 1, 2011

(54) CARRIER DEVICE FOR A TOROIDAL-CORE CHOKE, HOLDER FOR AN INDUCTIVE COMPONENT, AND INDUCTIVE COMPONENT

(75) Inventors: Guenter Feist, Gingen/Fils (DE); Juergen Stabenow, Heidenheim (DE)

(73) Assignee: Epcos AG, Munich (DE)

( * ) Notice: Subject to any disclaimer, the term of this patent is extended or adjusted under 35 U.S.C. 154(b) by 0 days.

(21) Appl. No.: 11/956,726

(22) Filed: Dec. 14, 2007

(65) Prior Publication Data

US 2008/0129436 A1 Jun. 5, 2008

Related U.S. Application Data

(63) Continuation of application No. PCT/DE2006/000641, filed on Apr. 11, 2006.

(30) Foreign Application Priority Data

Jun. 16, 2005 (DE) ..... 10 2005 027 943

(51) Int. Cl.
*H01F 27/28* (2006.01)

(52) U.S. Cl. ..... 336/229; 336/65; 336/67

(58) Field of Classification Search ..... 336/65, 336/229, 67
See application file for complete search history.

(56) References Cited

U.S. PATENT DOCUMENTS 1,653,951 A * 12/1927 Featherstone ..... 330/112
4,806,895 A * 2/1989 Petrow ..... 336/65
4,833,436 A * 5/1989 Martin et al. ..... 336/60
6,249,201 B1 * 6/2001 Lu ..... 336/65
6,249,208 B1 * 6/2001 Proks et al. ..... 336/210
6,690,257 B2 * 2/2004 Kobayashi et al. ..... 336/229
6,885,269 B2 * 4/2005 Miettinen et al. ..... 336/65
6,897,753 B2 * 5/2005 Dixon ..... 336/65
7,280,027 B2 10/2007 Feth et al.
2004/0169567 A1 9/2004 Okamoto
2007/0241855 A1 10/2007 Feist

FOREIGN PATENT DOCUMENTS

DE 80 15 111 U1 6/1980
DE 30 47 603 A1 7/1982
DE 36 13 862 A1 10/1987
DE 199 32 475 A1 2/2001
DE 102 23 995 C1 11/2003
DE 103 08 010 A1 9/2004
EP 1 220 242 A1 7/2002
JP 01119007 A * 5/1989
JP 9-260164 10/1997
JP 2002-118019 4/2002
JP 2002203723 A * 7/2002
JP 2003-272924 9/2003
JP 2004-55801 2/2004
WO WO 2005/073990 A1 8/2005
WO WO 2006/039875 A1 4/2006

* cited by examiner

*Primary Examiner*—Anh T Mai
*Assistant Examiner*—Joselito Baisa
(74) *Attorney, Agent, or Firm*—Slater & Matsil, L.L.P.

(57) ABSTRACT

A carrier device for a toroidal-core choke includes a base plate, which has projecting wire-guiding devices. A holder for an inductive component includes the carrier device and an electrical isolation device. The holder can be part of an inductive component.

25 Claims, 6 Drawing Sheets

CARRIER DEVICE FOR A TOROIDAL-CORE CHOKE, HOLDER FOR AN INDUCTIVE COMPONENT, AND INDUCTIVE COMPONENT

This application is a continuation of co-pending International Application No. PCT/DE2006/000641, filed Apr. 11, 2006, which designated the United States and was not published in English, and which is based on German Application No. 10 2005 027 943.0 filed Jun. 16, 2005, both of which applications are incorporated herein by reference.

TECHNICAL FIELD

A carrier device for a toroidal-core choke and also a holder with the carrier device will be described. Furthermore, an inductive component with the holder will be specified.

BACKGROUND

An insulating part is known, e.g., from the German patent publication DE 10223995 C1. The insulating part comprises the toroidal core of a toroidal-core choke and has projections for fixing wire windings and also for maintaining a grid pattern. In the middle area, the insulating part has connecting pieces, which provide electrical isolation.

Another insulating part is known, e.g., from German patent publication DE 10308010 A1 and corresponding U.S. Pat. No. 7,280,027. The insulating part has connecting pieces, which run radially outward and which can deform elastically due to pressure in the radial direction.

The problem to be solved consists in specifying a holder for a toroidal-core choke with several windings to be insulated from each other.

SUMMARY OF THE INVENTION

A carrier device for a toroidal-core choke will be specified. The carrier device comprises a base plate, which has projecting, elongated wire-guiding devices.

Various embodiments of the specified carrier device will be explained below.

The wire-guiding devices extend to the side of the base plate, which is provided for holding a toroidal-core choke.

The height of a wire-guiding device is selected so that a wire, which is guided in this device and which is allocated to a wire winding, is spaced apart relative to at least one other winding of the same toroidal-core choke. The height of a wire-guiding device can be selected, for example, so that it reaches at least up to the core hole shoulder or at least up to the center of the core hole. In one variant, the height of a wire-guiding device can even go beyond the center of the core hole.

The height of a wire-guiding device is preferably significantly greater than its outer transverse dimension and/or the transverse dimension of a wire to be guided in this device and/or the thickness of the base plate.

The height of a wire-guiding device can exceed the transverse dimension of a wire to be guided in this device preferably by at least a factor of two, and, in one variant, by at least a factor of three.

In one advantageous variant, the height of a wire-guiding device exceeds its outer transverse dimension or the thickness of the base plate by at least a factor of two, preferably by a factor of at least three.

A wire-guiding device preferably contains at least one wire-guiding channel, which is constructed in one variant as an elongated groove and in another variant as an elongated, continuous opening.

In one preferred embodiment, a choke area for the arrangement of a toroidal-core choke is provided between the wire-guiding devices.

The toroidal-core choke can be arranged upright between the wire-guiding devices. Here, the end faces of the toroidal-core choke are turned toward the wire-guiding devices and arranged transverse to the base plate.

A wire-guiding device can have a closed profile, a U-profile, or an H-profile. A wire-guiding device can be constructed, e.g., as a hollow tube or hollow cylinder or as a half -pipe open on one side. In principle, arbitrary cross sections of the wire-guiding device can be considered.

In the base plate, wire-guiding openings can be constructed, wherein a pair of these openings is used for maintaining the grid dimension of a wire winding of the toroidal-core choke.

The base plate can be partitioned in one longitudinal direction into edge areas and at least one center area arranged between these edge areas, wherein two wire-guiding devices are arranged in at least one center area and lie opposite each other.

Preferably, in each area of the base plate, there are two wire feedthrough openings for each wire winding. The two wire feedthrough openings of an area are preferably arranged along a transverse direction.

A wire-guiding channel runs transverse to the base plate and opens into one wire feedthrough opening.

In one advantageous variant, a wire-guiding device has projections or rails or guides, which extend along the main axis of the wire-guiding device, on its side facing the choke area. The ends of the projections facing away from the base plate are preferably beveled.

In one variant, a wire-guiding device has a catch device, which is turned toward the choke area and which is defined on both sides preferably by the projections. The catch device has, for example, ribs or catch elements suitable for teeth.

The specified carrier device can be inserted into a holder, which is provided for an inductive component and which further comprises a holder device that can be inserted into the core hole of a toroidal-core choke. This holder device can be fixed on a catch device of the wire-guiding devices, e.g., by means of its catch device arranged preferably on the end. The catch devices of the holder device are here constructed preferably as a complementary part to the catch devices of the wire-guiding devices. A complementary part is understood to be, in particular, a fitted part constructed to form a positive fit with the original.

A part of the holder device carrying the catch devices is constructed to project past the toroidal core in the axial direction preferably on both sides.

The holder device can be fixed in the core hole preferably by elastic forces. The holder device is preferably made from an electrically insulating material. It can be, e.g., an electrical isolation device, which has a star-shaped construction in one variant.

The described holder is especially suitable for an inductive component with a toroidal-core choke. The toroidal-core choke comprises a toroidal core and several wire windings, which are wound around the core and whose ends are guided through the wire feedthrough openings of the base plate. The holder device preferably provided as the electrical isolation device is inserted into the core hole of the toroidal core and fixed between the wire-guiding devices, wherein ends of one of the wire windings are guided in the wire-guiding channels of the wire-guiding devices.

BRIEF DESCRIPTION OF THE DRAWINGS

Below, the carrier device, the holder for an inductive component, and an inductive component will be explained with reference to schematic figures that are not to scale. Shown are.

Figure 1:
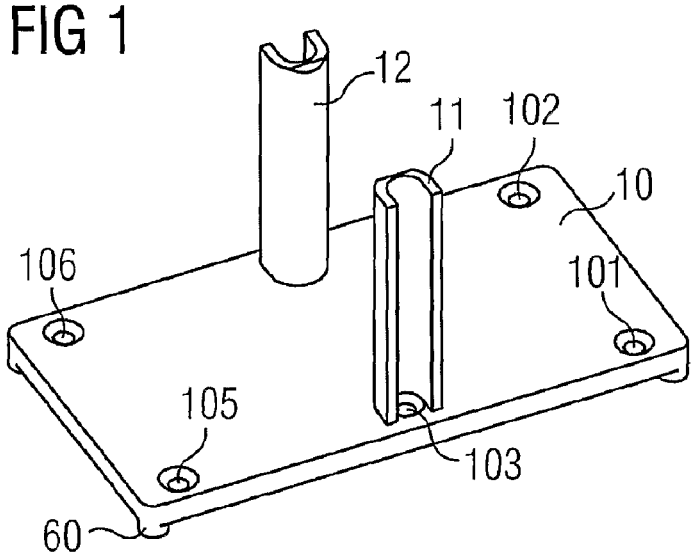
FIG. 1, an example carrier device for a toroidal-core choke in a perspective view.

The following reference symbols are used in conjunction with the drawings:

10 Base plate
101-106 Grid openings
11, 12 Wire-guiding device
111, 112, 121 Rails
113, 123 Catch device
2 Toroidal core
31, 32, 33 Ends of wire windings
41, 42, 43 Wire windings
5 Electrical isolation device
50 Catch surface
501, 502, 503 Deformable connecting pieces
511, 512, 513 Insulating areas
55 Center part of the electrical isolation device
60 Spacing feet

DETAILED DESCRIPTION OF ILLUSTRATIVE EMBODIMENTS

Figure 2:
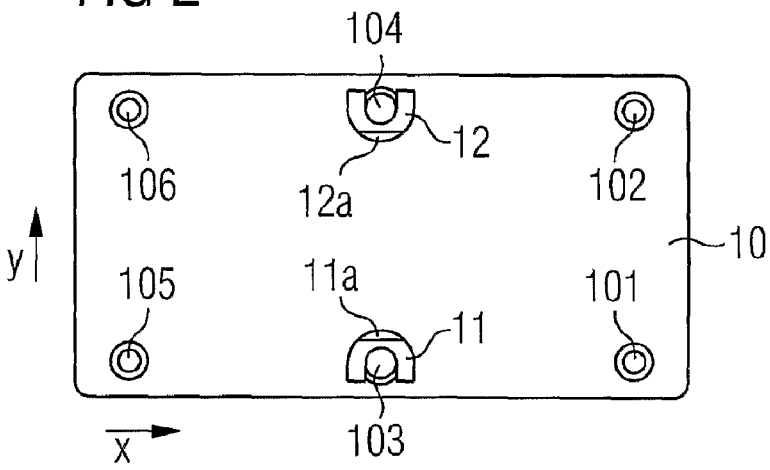
FIG. 2, the carrier device according to FIG. 1 in a plan view from above.
Figure 7:
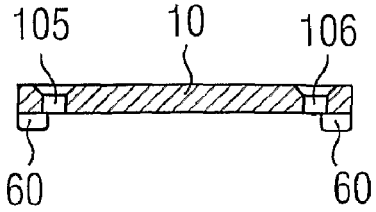
FIG. 7, the carrier device according to FIGS. 1 and 8 in a cross section perpendicular to the longitudinal direction of the base plate.
Figure 3:
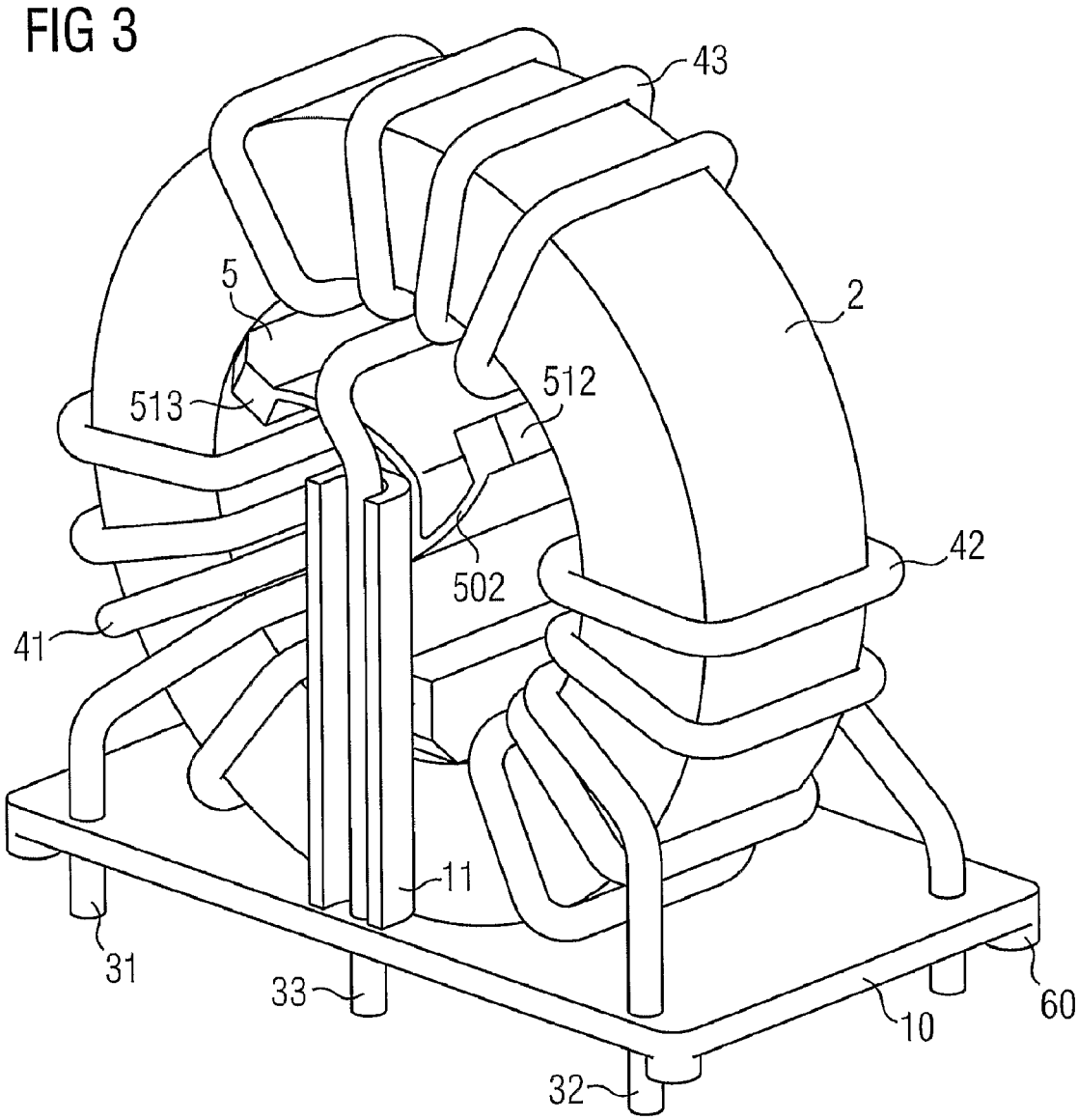
FIG. 3, an inductive component with a toroidal-core choke, the carrier device for the toroidal-core choke according to FIG. 1, and an electrical isolation device inserted into the core hole.

FIGS. 1, 2, and 7 show various views of a carrier device, which is used as a carrier for a coil body or a toroidal-core choke. An entire inductive component with this carrier device is shown in FIG. 3. In FIG. 7, a cross section of the carrier device is shown in the area of wire feedthrough openings 105 and 106.

The carrier device comprises a base plate 10, which has wire-guiding devices 11, 12 projecting in one direction (upward). The wire-guiding devices 11, 12 are rod-like formations each with a wire-guiding channel facing away from the choke area. The wire-guiding devices 11, 12 are here constructed with a U-profile.

The carrier device is preferably made from an electrically insulating material. In particular, plastics suitable for injection molding can be used.

The base plate 10 and the wire-guiding devices 11, 12 are preferably generated in one piece, i.e., in one processing step. However, it is also possible to produce the base plate 10 and the wire-guiding devices 11, 12 from one material or each from different materials separately and to connect them rigidly to each other monolithically. It is also possible to first prepare the base plate 10 and to generate the wire-guiding devices 11, 12 on this base plate in a subsequent processing step.

The toroidal-core choke to be seen in FIG. 3 comprises a toroidal core 2 and three wire windings 41, 42, 43, which are wound onto this core and which each lie at a unique electrical potential.

The wire-guiding devices 11, 12 are each used for secure spacing of the wire ends 33 of the wire winding 43 from the other wire windings 41, 42. In this way, it is possible to use wire windings without an insulating covering. Wire windings coated with an insulating layer or, optionally uninsulated wire windings, can be used.

The base plate 10 is partitioned in one longitudinal direction x into two edge areas and one center area. The wire-guiding devices 11, 12 are arranged in the center area of the base plate 10. The wire-guiding devices 11, 12 stand perpendicular to the longitudinal direction x of the base plate 10 relative to each other. A choke area for holding a toroidal-core choke is provided between the wire-guiding devices 11, 12.

For each area, two wire feedthrough openings 101 and 102, 103 and 104, 105 and 106 are provided (see FIG. 2). The openings 101 to 106 are arranged in pairs along a transverse direction y. The opening pairs are each used for maintaining the grid pattern of the ends 31, 32, 33 of each wire winding 41, 42, 43 (see FIG. 3). The openings 101 and 102 are here used for passing both ends 32 of the wire winding 42. The openings 103 and 104 are used analogously for passing ends 33 of the wire winding 43, or the openings 105 and 106 are used for passing ends 31 of the wire winding 41.

The wire-guiding channels of the wire-guiding devices 11 and 12 open into the openings 103 and 104, respectively.

The carrier device is preferably constructed symmetrically relative to an axis running through its center and parallel to the direction x or y.

The openings 101 to 106 are preferably constructed as openings 105, 106 shown in FIG. 7, wherein they have a section with inner walls running perpendicular to the main surface of the base plate 10 and also another section, which has a widened section in cross section relative to the top side of the base plate. The latter section simplifies the insertion of the wire ends 31, 32, 33 into the corresponding opening. The cross section and the transverse dimension of the first section of the appropriate opening are preferably adapted to the cross section or the outer dimension of the wire ends 31, 32, 33.

Spacing feet 60 for maintaining spacing between the base plate 10 and a circuit board (not shown here) provided for the mounting of the inductive component are provided on the bottom side of the base plate 10.

End sections of the wire winding 43 are fixed by the walls of the wire-guiding devices 11, 12. Preferably, these end sections are countersunk in each wire-guiding channel, so that the wire section does not project in cross section beyond the wire-guiding devices 11, 12 on the open side of these devices.

The wire-guiding devices 11, 12 each have a surface 11*a* and 12*a*, respectively (see FIG. 2), which is turned towards the top side of these devices and runs at an angle to its outer surface and its top side. This inclination makes the insertion of a toroidal core between the wire-guiding devices 11, 12 easier.

FIG. 3 shows an inductive component with an already-explained carrier device and an electrical isolation device 5 constructed as a complementary part to this carrier device.

The end sections of the wire windings 43 are each fixed in the axial direction of the wire-guiding channel, that is, perpendicular to the base plate 10. Therefore, because end sections of the wire winding 43 running perpendicular to the base plate 10 are each fixed in the wire-guiding channel of the wire-guiding device 11 or 12, wherein lateral slippage of the winding is prevented, the position of the toroidal-core choke is also fixed relative to the base plate 10.

Figure 8:
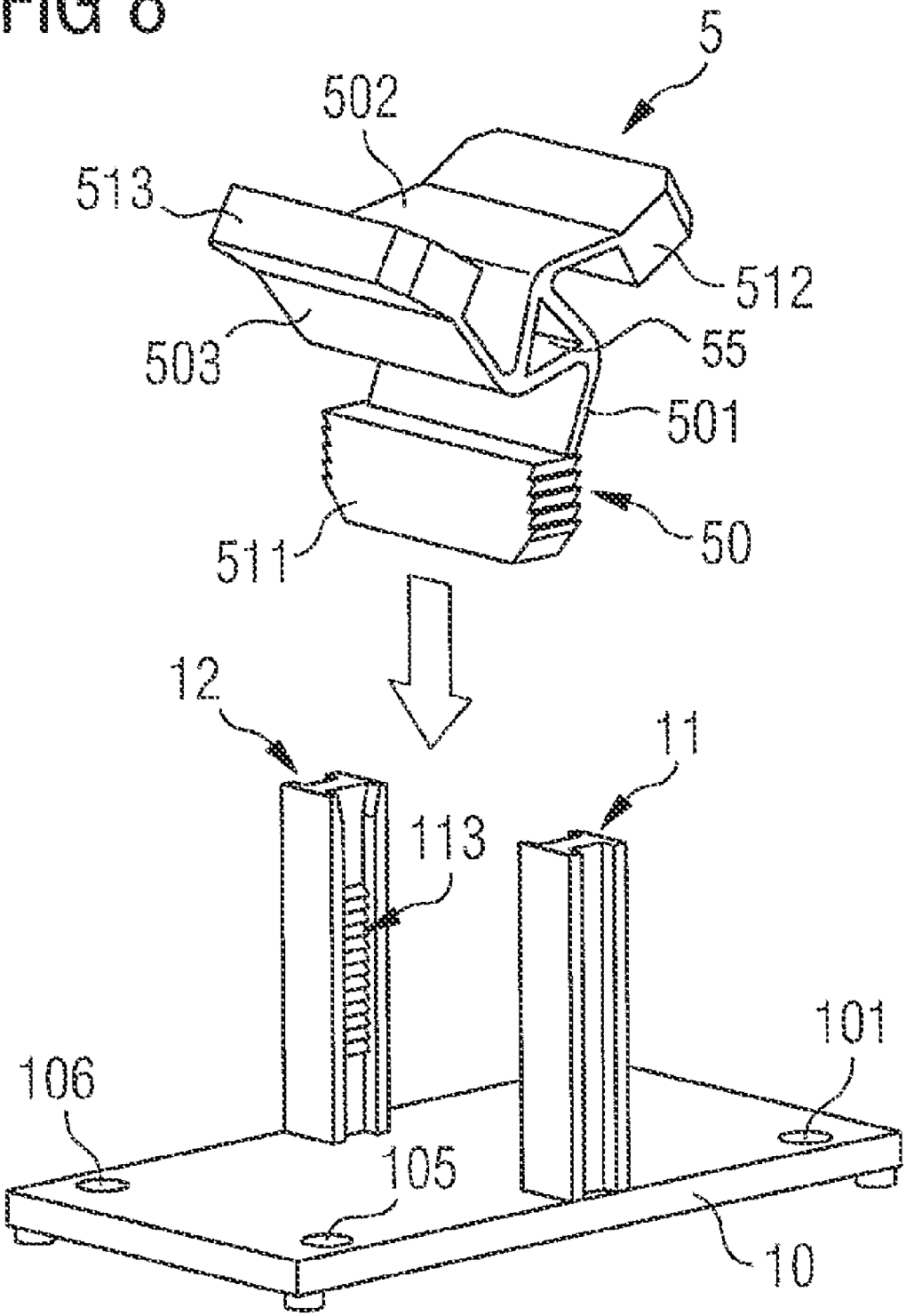
FIG. 8, in a perspective view, a holder arrangement for an inductive component, the carrier device according to FIGS. 4, 8 (bottom) and an electrical isolation device (top) constructed as a complementary part to this carrier device.

The electrical isolation device 5 also shown in FIG. 8 is inserted into the core hole of the toroidal core 2. It has a center part 55 and also, in this variant, three elastically deformable connecting pieces 501 to 503, which project from this center part and which extend in a star shape and on which insulating areas 511, 512, 513 facing away from the center are provided.

In another variant, the connecting pieces of an electrical isolation device can be non-deformable and can have elastically deformable, preferably expandable, devices at their ends turned toward the toroidal core.

Figure 4:
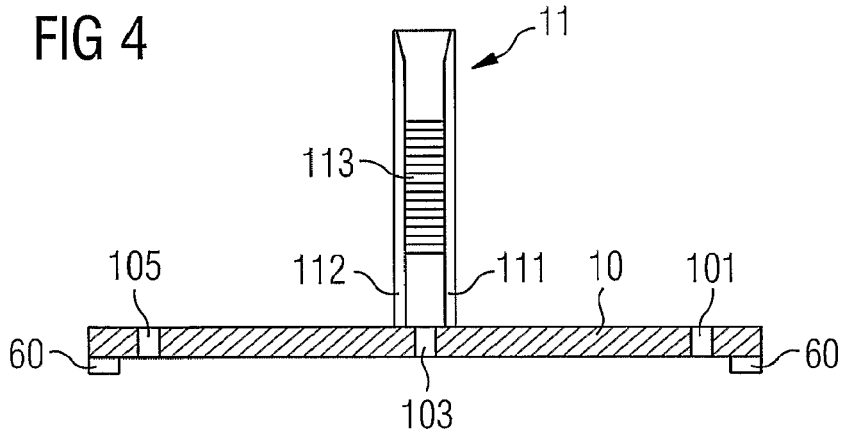
FIG. 4, another carrier device in a cross section parallel to the longitudinal direction of the base plate.
Figure 5:
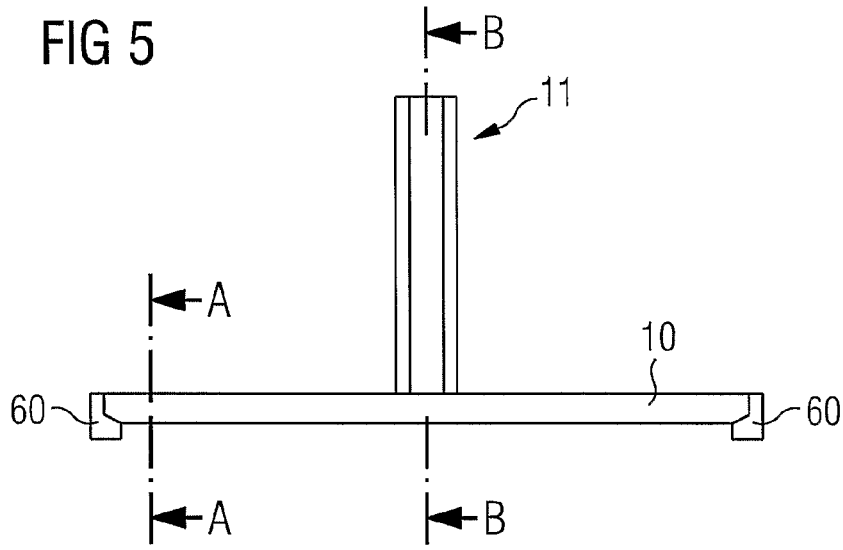
FIG. 5, a side view of the carrier device according to FIGS. 4, 8.
Figure 6:
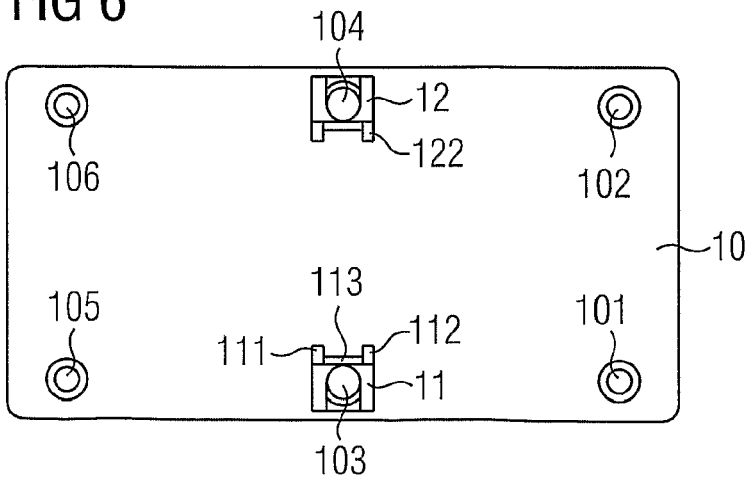
FIG. 6, the carrier device according to FIGS. 4, 8 in a plan view from above.
Figure 9:
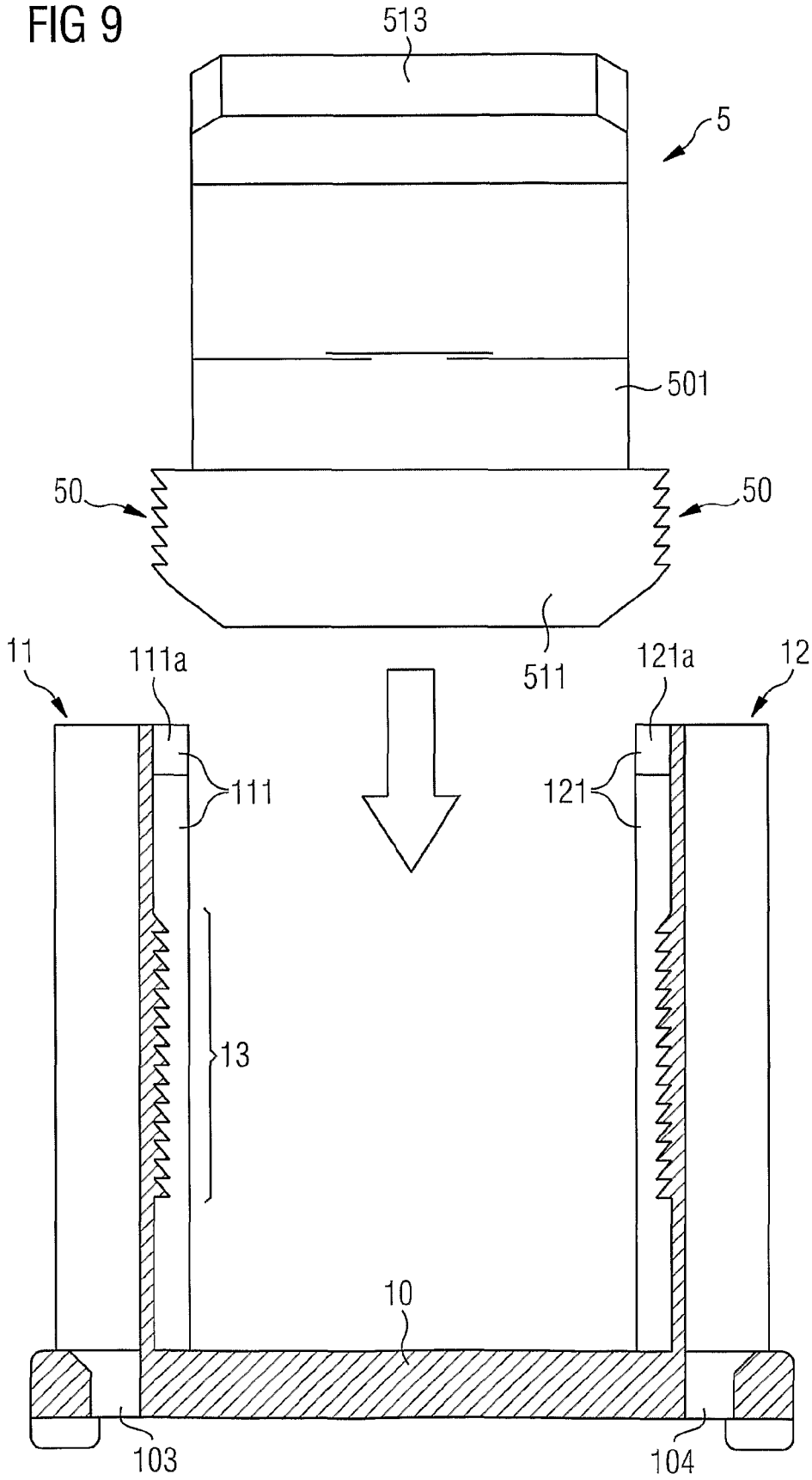
FIG. 9, the holder arrangement according to FIG. 8 in a partial cross-sectional view before the insertion of the electrical isolation device in the carrier device.
Figure 10:
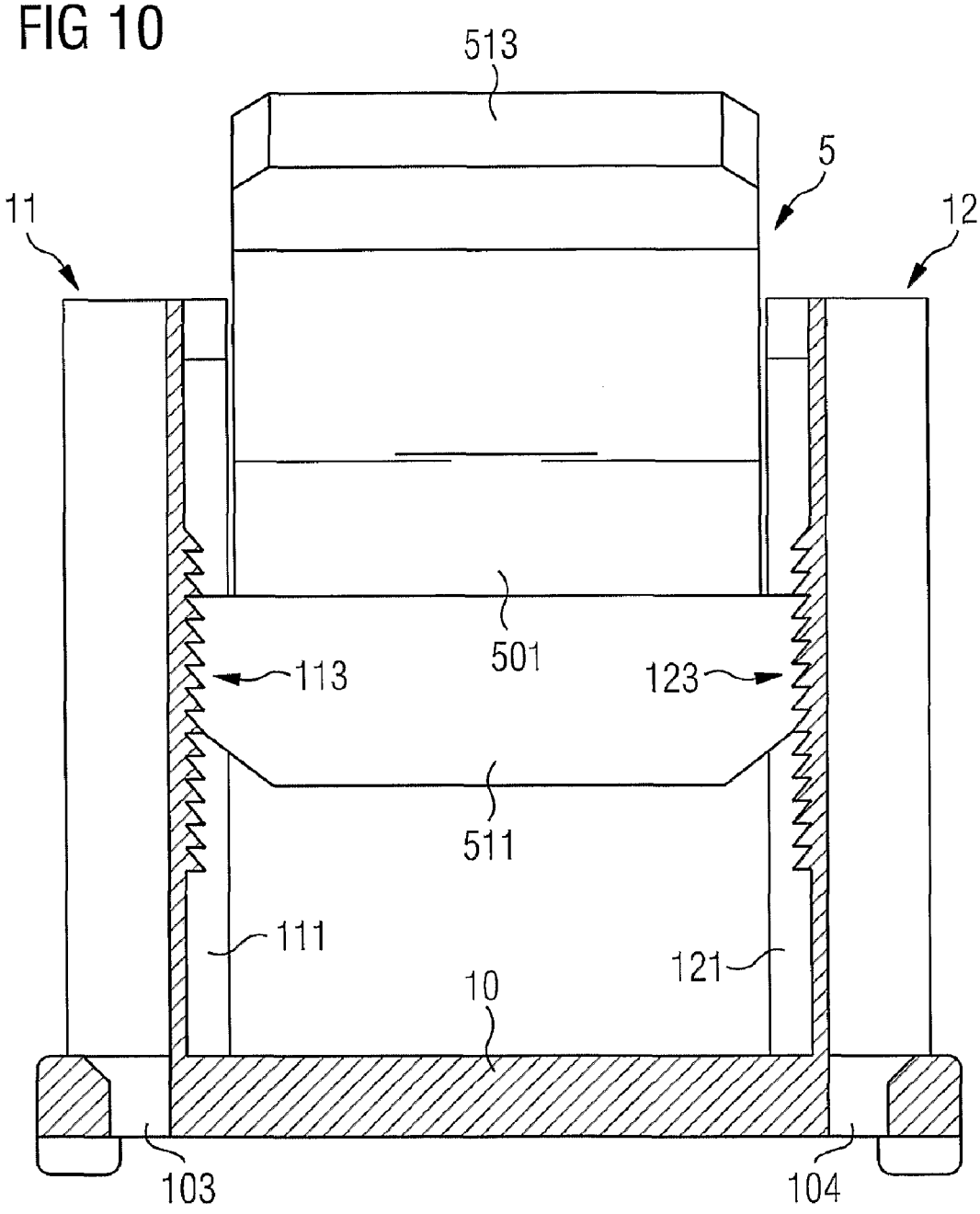
FIG. 10, the holder arrangement according to FIGS. 8, 9 after the insertion of the device in the carrier device.

In FIGS. 4 to 6, another advantageous embodiment of a carrier device for a toroidal-core choke is shown in different views. In FIGS. 8 to 10, different views of a holder are shown, which comprise this carrier device and an electrical isolation device 5 that can be inserted into a core hole. The carrier device according to the second embodiment is preferably constructed essentially like the carrier device according to the first embodiment up to the differences explained below and visible from the figures.

The wire-guiding devices 11 and 12 have a mirror-symmetric construction. Their construction will be explained with reference to the wire-guiding device 11.

FIG. 4 shows a partial cross-sectional view of the carrier device according to the second embodiment with a view of the wire-guiding device 11 from the inside.

The wire-guiding device 11 has a catch device 113 on its inner side turned toward the toroidal-core hole. This catch device is here constructed as a catch surface with a rib. The rib runs along the axis of the wire-guiding device 11. The rib is here constructed so that an electrical isolation device 5 can slide toward the base plate 10 but cannot slide in the opposite direction.

The catch device 113 is defined on both sides by rails 111 and 112. The rails 111 and 112 represent projections of the wire-guiding device 11 turned in the direction toward the toroidal-core choke. These rails run parallel to the axis of the wire-guiding device.

The rails 111 and 112 are inclined relative to the top side of the wire-guiding device, such that the insertion of an electrical isolation device 5 is made easier.

The part of the electrical isolation device 5 turned toward the wire-guiding device 11 is preferably constructed so that it can slide without problem between the rails 111, 112 but cannot slip laterally.

A side view of the carrier device according to FIG. 4 is shown in FIG. 5. Here, the outer side of the wire-guiding device 11 can be seen.

The section AA of the carrier device according to FIGS. 4 to 6 is shown in FIG. 7. The section BB of this carrier device can be seen in FIGS. 9 and 10.

FIG. 6 shows that the wire-guiding devices 11, 12 each have an essentially H-shaped profile.

FIG. 8 shows a holder for an inductive component with an electrical isolation device 5 (top) and a carrier device (bottom), already explained in connection with FIGS. 4 to 6.

The electrical isolation device 5 is inserted in the core hole of the toroidal core 2 and is preferably fixed in this core, e.g., by means of elastic forces. With a block arrow it is shown that the electrical isolation device 5, preferably after insertion into the core hole of a toroidal core, is pushed between the wire-guiding devices 11 and 12 and fixed therebetween by means of catch devices 50, 113 in the vertical direction and also by means of projections of the wire-guiding devices in the longitudinal direction.

FIG. 9 shows the holder shown in FIG. 8 in another view.

Catch projections 50 formed as ribs are constructed on both end faces of the rigid insulating area 511. The rigid insulating area 511, that is, the part of the electrical isolation device 5 carrying the catch projections 50, extends on both sides in the axial direction past other parts of the electrical isolation device. Preferably, the axial size of the other parts of the electrical isolation device is adapted to the axial size of the toroidal core, wherein the insulating area 511 projects to both sides of the core and is thus suitable for fixing the arrangement made from the electrical isolation device 5 and the core 2.

In FIG. 9, only one projection 111 or 121 of the wire-guiding device 11 or 12 is visible. An upper end of the projection 111, 121 has a beveled surface 111*a* or 121*a*. Here, beveled surfaces of the projections allocated to the same wire-guiding device are turned toward each other.

In FIG. 10, the holder according to FIGS. 8 and 9 is shown after the locking of the electrical isolation device 5 between wire-guiding devices 11 and 12. The latch devices of a wire-guiding device and the electrical isolation device are adapted to each other to form a positive fit. The latch devices 50, 113, 123 are constructed as locking mechanisms, wherein the upward movement of the electrical isolation device 5 is prevented by the preferred direction of the teeth.

The wire-guiding devices 11, 12 can have an arbitrary cross section or the wire-guiding channel with an arbitrary cross section. In one variant, the wire-guiding devices 11, 12 can be constructed as hollow tubes or hollow cylinders. The cross section of the wire-guiding channel is preferably adapted to the shape of the wire 31 to 33.

The shape of the base plate can be selected arbitrarily, although a rectangular or square construction is preferred.

The number of wire windings can differ from three. The number of wire feedthrough openings is preferably adapted to the number of wire windings. For a number N>3 of wire windings, preferably N−2 center areas of the base plate 10 are provided, wherein a pair of wire-guiding devices lying opposite each other is allocated to each of these center areas.

What is claimed is:

1. A carrier device for a toroidal-core choke, the carrier device comprising:

a base plate; and at least two elongated wire-guiding devices projecting from the base plate such that the wire-guiding devices extend at least to a height of a core hole shoulder of the toroidal-core choke such that a wire-guiding channel of each wiring-guide device is configured to guide a wire at least up to the core hole shoulder, wherein end faces of the toroidal-core choke are turned toward the wire-guiding devices.

2. The carrier device according to claim 1, wherein the wire-guiding devices extend to a side of the base plate provided for holding the toroidal-core choke.

3. The carrier device according to claim 1, wherein the wire-guiding devices each have a height that exceeds a transverse dimension of a wire to be guided in the carrier device by a factor of at least two.

4. The carrier device according to claim 1, wherein the wire-guiding devices each have a height that exceeds an outer transverse dimension of each wire-guiding device by a factor of at least two.

5. The carrier device according to claim 1, wherein the wire-guiding devices each have a height that exceeds a thickness of the base plate by a factor of at least two.

6. The carrier device according to claim 1, wherein the wire-guiding devices each comprise at least one wire-guiding channel.

7. The carrier device according to claim 1, further comprising a choke area for an arrangement of the toroidal-core choke, the choke area being provided on the base plate between the wire-guiding devices.

8. The carrier device according to claim 7, wherein the toroidal-core choke can be arranged upright between the wire-guiding devices.

9. The carrier device according to claim 7, wherein at least one of the wire-guiding devices has projections that run along a main axis of the wire-guiding device on a side of the wire-guiding device facing the choke area.

10. The carrier device according to claim 1, wherein the wire-guiding devices have a U-profile.

11. The carrier device according to claim 1, wherein the wire-guiding devices are each constructed as a hollow tube.

12. The carrier device according to claim 1, further comprising wire feedthrough openings constructed in the base plate.

13. The carrier device according to claim 1, wherein the base plate is partitioned in one longitudinal direction into edge areas and at least one center area arranged between the edge areas, wherein the wire-guiding devices are arranged in the at least one center area.

14. The carrier device according to claim 13, further comprising two wire feedthrough openings for each wire winding, the two wire feedthrough openings being provided in each area of the base plate.

15. The carrier device according to claim 14, wherein the two wire feedthrough openings of an area are arranged along a transverse direction.

16. The carrier device according to claim 14, wherein the wire-guiding devices each comprise at least one wire-guiding channel, wherein the wire-guiding channels run perpendicular to the base plate and open into wire feedthrough openings.

17. The carrier device according to claim 1, further comprising spacing feet attached to a bottom side of the base plate.

18. A carrier device for a toroidal-core choke, the carrier device comprising:

a base plate;

at least two elongated wire-guiding devices projecting from the base plate; and a choke area for an arrangement of a toroidal-core choke, the choke area being provided on the base plate between the wire-guiding devices;

wherein at least one of the wire-guiding devices has projections that run along a main axis of the wire-guiding device on a side of the wire-guiding device facing the choke area; and wherein an end of a projection facing away from the base plate is beveled.

19. A carrier device for a toroidal-core choke, the carrier device comprising:

a base plate;

at least two elongated wire-guiding devices projecting from the base plate; and a choke area for an arrangement of a toroidal-core choke, the choke area being provided on the base plate between the wire-guiding devices such that the wire-guiding devices extend at least to a height of a core hole shoulder of the toroidal-core choke such that a wire-guiding channel of each wiring guide device is configured to guide a wire at least up to the core hole shoulder;

wherein at least one of the wire-guiding devices has a catch device turned toward the choke area.

20. The carrier device according to claim 19, wherein the at least one of the wire-guiding devices has projections that run along a main axis of the wire-guiding device on a side of the wire-guiding device facing the choke area such that a catch device of each wire-guiding device is limited laterally by the projections.

21. The carrier device according to claim 20, wherein the catch device has a rib.

22. A holder for an inductive component, the holder comprising:

a carrier device comprising a base plate and elongated wire-guiding devices projecting from the base plate, each wire-guiding device including a catch device; and an electrical isolation device that can be inserted in a core hole of a toroidal-core choke and that can be fixed to the catch devices of the wire-guiding devices.

23. The holder according to claim 22, wherein the electrical isolation device has catch devices on an end, wherein the catch devices of the electrical isolation device can be fixed on the catch devices of the wire-guiding devices.

24. The holder according to claim 23, wherein the catch devices of the electrical isolation device are constructed as complementary parts to the catch devices of the wire-guiding devices.

25. An inductive component comprising:

a carrier device comprising a base plate and elongated wire-guiding devices projecting from the base plate, each wire-guiding device including a catch device;

a toroidal core disposed between the wire guiding devices;

an electrical isolation device that can be inserted in a core hole of a toroidal-core choke and that can be fixed to the catch devices of the wire-guiding devices, wherein the electrical isolation device is inserted in the core hole of the toroidal-core choke and is fixed to the wire-guiding devices; and several wire windings with ends guided through wire feedthrough openings of the base plate, wherein ends of one of the wire windings are guided in the wire-guiding devices.

* * * * *